US005697854A

United States Patent [19]

Aizawa et al.

[11] Patent Number: 5,697,854

[45] Date of Patent: Dec. 16, 1997

[54] GOLF CLUB HEAD AND METHOD OF MANUFACTURING THE SAME

[75] Inventors: Yuichi Aizawa; Shoichi Dekura, both of Tokyo, Japan

[73] Assignee: Daiwa Seiko, Inc., Tokyo, Japan

[21] Appl. No.: 412,443

[22] Filed: Mar. 29, 1995

[30] Foreign Application Priority Data

Mar. 29, 1994 [JP] Japan ..... P.HEI. 6-59240

[51] Int. Cl.[6] ..... B23K 31/10

[52] U.S. Cl. ..... 473/344; 473/327; 473/328

[58] Field of Search ..... 473/330, 315, 473/344, 305, 206, 327, 345, 350, 322, 328

[56] References Cited

U.S. PATENT DOCUMENTS

| | | | |
|---|---|---|---|
| 5,094,383 | 3/1992 | Anderson et al. | 473/345 |
| 5,106,094 | 4/1992 | Desbiolles et al. | 273/167 H |
| 5,294,037 | 3/1994 | Schmidt | 473/327 |

FOREIGN PATENT DOCUMENTS

| | | |
|---|---|---|
| 62-207474 | 9/1987 | Japan . |
| 2-206481 | 8/1990 | Japan . |
| 6-7876 | 2/1994 | Japan . |

*Primary Examiner*—Vincent Millin
*Assistant Examiner*—Charles W. Anderson
*Attorney, Agent, or Firm*—Longacre & White

[57] ABSTRACT

The invention relates to a golf club head and a method of manufacturing the same, the external surface of which a plate is attached as a sole plate or face plate. A pair of protruding pieces which protrude approximately in the opposite direction with respect to the center of the plate are provided in the periphery of the plate, and the protruding pieces are respectively embedded in a head body of the golf club head. The ends of the protruding pieces are extended so that they are exposed onto the external surface of the head body. By this arrangement, the plate can be positively fixed to a predetermined position without causing removal from the head body, and thus there is no possibility that the plate comes off from the head body even if an impact is given to the head body when a ball is hit.

15 Claims, 5 Drawing Sheets

GOLF CLUB HEAD AND METHOD OF MANUFACTURING THE SAME

BACKGROUND OF THE INVENTION

The present invention relates to a golf club head and a method of manufacturing the golf club head.

From the viewpoints of stabilizing the quality and making it easy to procure the material, instead of natural wood such as persimmon or cherry, titanium alloy or aluminum alloy is formed into a hollow external shell, or a core (filling member) made of foaming synthetic resin is covered with a fiber reinforced resin layer such as a carbon fiber reinforced resin layer or a glass fiber reinforced resin layer, to manufacture a head main body of a golf club head referred to as a wood, which will be referred to as a "head" in this specification hereinafter. Golf clubs made in the above manner are widely put into practical use recently.

Further, there is a tendency that a face plate made of fiber reinforced resin or metal is attached onto a face of the head body in order to extend the flying distance of a ball, or a sole plate made of metal, the specific gravity of which is higher than that of the head body, is attached to the sole portion of the head in order to adjust the weight so that a position of the center of gravity is lowered.

Conventionally, the sole plate or face plate is fixed to the head body by means of screws or adhesive. Also, in the case of a face plate, it is engaged with and fixed to a recess provided on the face portion. Accordingly, there is a possibility that the screws and engaging portions are unfastened or the adhesive is peeled off by the action of vibration caused when the golf club is used.

Recently, the following head and manufacturing method thereof are disclosed in Japanese Unexamined Patent Publication No. 62-207474: As illustrated in FIG. 8, a face plate 3 is attached onto a surface of a fusible core 1, and the fusible core 1 with the face plate 3 is accommodated in a mold 5 composed of a plurality of blocks 5*a*, 5*b*, 5*c*. Metallic material is then poured into a cavity 8 from a pouring gate 7 so as to conduct pressure casting. Then the core 1 is removed by drilling chaplets 9 supporting the core 1. In this way, the head 13 is provided, in which the face plate 3 is attached onto the face 12 of the head body 11 as illustrated in FIG. 9.

However, even if the face plate 3 is retained onto the face 12 by the internal-chill casting process when the head body 11 is cast, since the face plate 3 has no means for engaging with the head body 11, there is a possibility that the face plate 3 is peeled off from the head body 11 by the vibration caused in the use of a golf club, and the face plate 3 is disconnected from the face 12.

Different from attaching the face plate and sole plate, Japanese Unexamined Patent Publication No. 2-206481 or Japanese Patent Publication No. 6-7876 discloses a head and a manufacturing method thereof in which a weight adjusting member is embedded in an iron head body during the casting process of the head.

FIG. 10 is a view showing a mold used for the method of manufacturing a head disclosed in Japanese Unexamined Patent Publication No. 2-206481. On a mating surface of the split type mold 14, there are provided recess portions 17, 18 communicated with the cavity 15 for receiving and holding base portions of the support pins 19.

While the weight adjusting member 21 is held by the support pins 19 in the cavity 15 as illustrated in the drawing, molten metal is poured from the pouring gate 23 into the cavity 15. In this way, a head is manufactured by casting so that the weight adjusting member 21 is included in the main body of the head.

However, when this method is applied to a case in which the face plate is attached to the main body, a hole formed as a result of removal of the support pin 19 is left, which requires troublesome after-treatment. Even when the method illustrated in FIG. 8 is adopted, troublesome after-treatment is required for the holes 25 shown in FIG. 9 which are formed to remove the core 1.

Further, Japanese Patent Publication No. 6-7876 discloses a head 37 and a manufacturing method thereof illustrated in FIGS. 11 and 12, in which a substantially U-shaped weight adjusting member 29 made of material, the melting point of which is different from that of the head body 27, and the specific gravity of which is higher than that of the head body 27, is arranged in the head body 27, and while extending portions 33 provided at both large weight portions 31 are exposed onto the heel and toe sides of the back portion 35 of the head body 27, the parts are subjected to casting so as to be fixed at predetermined positions in the head 37.

However, this method is disadvantageous in that the weight adjusting member 29 is supported only by the back portion 35 in the manner of cantilever, so that the weight adjusting member 29 is inclined and shifted from a predetermined position in the process of casting.

SUMMARY OF THE INVENTION

In view of the above problems, the present invention has been accomplished. It is an object of the present invention to provide a golf club head and a method of manufacturing the golf club head, in which when a plate such as a face plate and/or a sole plate is positively fixed to a predetermined position without the accidental removal therefrom, and which assures no possibility that the plate is disconnected from the head body even when a shock is given to the head by hitting a ball.

In order to attain the above-noted and other objects, the invention provides a golf club head comprising: a head body; and a plate attached onto said head body. The plate has at least a pair of protruding pieces protruding from an periphery of said plate approximately in opposite directions to each other. The protruding pieces are embedded in and elongated through said head body so that end faces of said protruding pieces are exposed from said head body. According to the invention, even when a shock is given to the head body by hitting a ball, the protruding pieces embedded in the head body strongly hold the plate and prevent the plate from becoming detached from the head body.

In case that the plate is attached to a sole of the head body, the plate is preferably made of material, the specific gravity of which is higher than that of the head body so that the plate functions as a weight adjusting member which lowers the center of gravity of the head.

In case that the plate is attached to a face of the head body, the plate is preferably made of material higher in elastic module than that of the head body so that the plate can effectively apply a repulsive force to a ball to extend flying distance of the ball.

The invention further provides a method of manufacturing a golf club head comprising the steps of: providing a plate having at least a pair of integral protruding pieces protruded from a periphery of said plate in opposite directions to each other; retaining said plate onto a mold made up of a plurality of blocks through said protruding pieces; filling said mold with material to form a first head body with said protruding pieces embedded in said first head body; and removing ends of said protruding pieces protruding from said first head body to provide a smooth external configuration of said first head body.

According to the manufacturing method of the invention, after the plate has been arranged through the protruding pieces in the mold, the mold is filled with material for forming the head body so that the plate is attached onto the external surface of the head body while the protruding pieces except for the ends are embedded in the material for forming the head body. Then, the ends of the protruding pieces which protrude from the head body are simply removed along the external shape of the head body. Therefore, the head body capable of providing the above effects can be easily manufactured.

In manufacturing the head body, the protruding pieces of the plate are preferably held by blocks of the mold so that the displacement of the plate during casting of the head body is positively prevented.

DETAILED DESCRIPTION OF THE PREFERRED EMBODIMENTS

Preferred embodiments of the present invention will be explained in detail with reference to the accompanying drawings.

Figure 1:
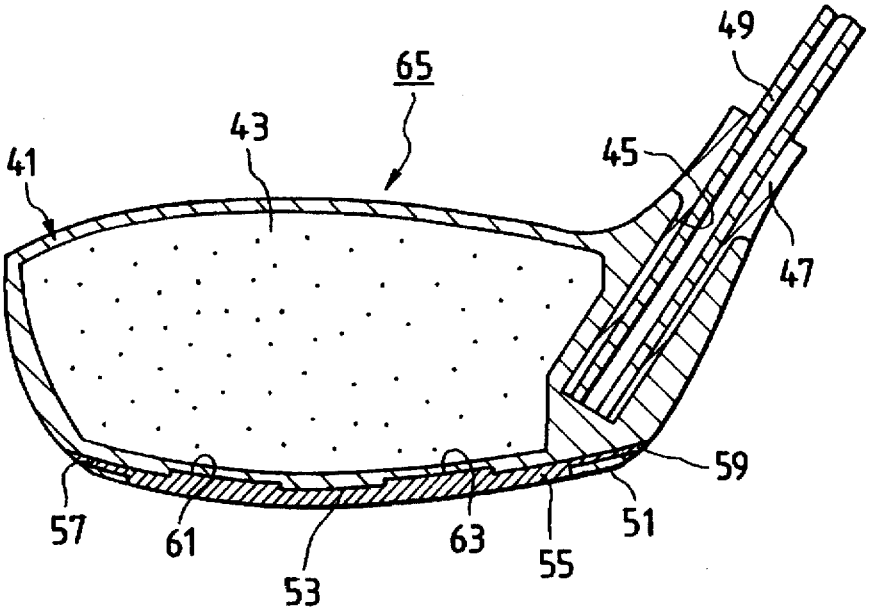
FIG. 1 is a sectional view of a golf club head according to an embodiment of the invention.
Figure 2:
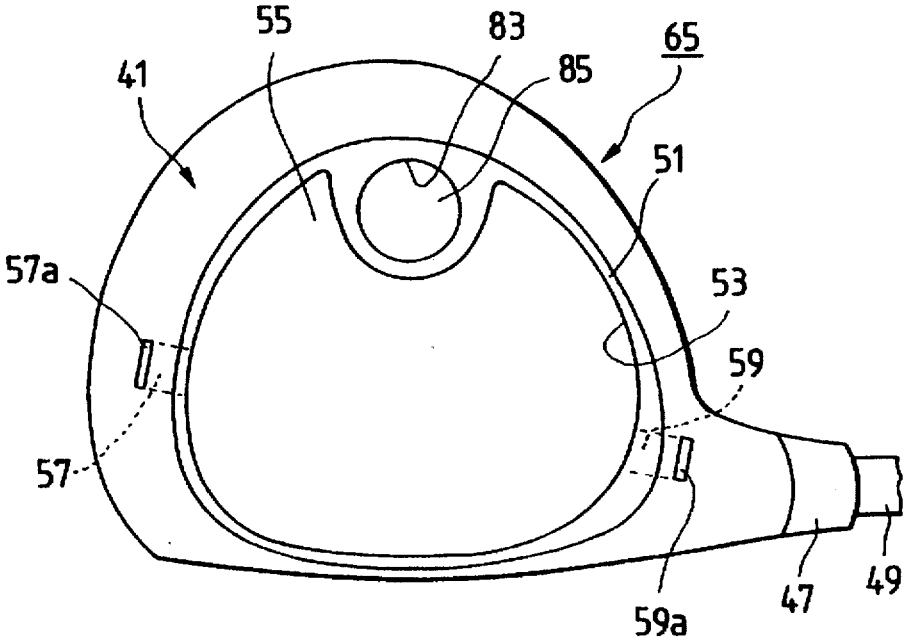
FIG. 2 is a bottom view of the head shown in FIG. 1.

FIGS. 1 and 2 show a golf club head according to an embodiment of the invention. In FIGS. 1 and 2, reference numeral 41 designates a head body in the form of a hollow shell made of metal such as magnesium alloy (specific gravity: 1.8) or aluminum alloy (specific gravity: 2.8). The head body 41 is filled with a filling material 43 made of foaming synthetic resin.

A hosel attaching section 45 is provided on the heel side of the head body 41. Into the hosel attaching section 45, a hosel 47 is inserted, which is made of synthetic resin, for example, ABS, polycarbonate, epoxy, and mixture in which one of these resins is mixed with powder of carbon, kevler or glass. Through the hosel 47, a shaft 49 made of metal or resin such as FRP is attached to the head body 41. Since the shaft 49 is attached to the head body 41 through the hosel 47 in the above manner, an impact is absorbed by the hosel 47 when the head boy 41 hits a ball, so that the hosel 47 functions as a cushioning member for absorbing the impact transmitted from the head body 41 to the shaft 49.

A recess 53 having a bottom portion is provided on the sole 51 of the head body 41, and a sole plate 55 made of metal of high specific gravity, the melting point of which is higher than that of the head body 41, for example, stainless steel (specific gravity: 7.8), copper alloy (specific gravity: 7.8 to 8.9), nickel alloy (specific gravity: 8.7), and cobalt alloy (specific gravity: 8.8), is attached into the recess 53 in such a manner that the surface of the sole plate 55 is flush with the surface of the sole 51 around the recess.

A pair of protruding pieces 57, 59 are integrally formed on the sole plate 55 so as to protrude from the periphery of the sole plate 55 and extend toward the toe and heel sides of the head body 41. In this embodiment, the protruding pieces 57, 59 are provided at laterally opposite locations with respect to the center of the sole plate 55. The protruding pieces 57, 59 are embedded in the head body 41, and the respective ends 57*a*, 59*a* of the protruding pieces are exposed onto an external surface of the head body 41. As illustrated in FIG. 1, protruding portions 61, 63 are provided on an upper surface of the sole plate 55, and engaged with the bottom portions of the recess portions 53.

The head 65 of the invention is manufactured by the following method.

Figure 3:
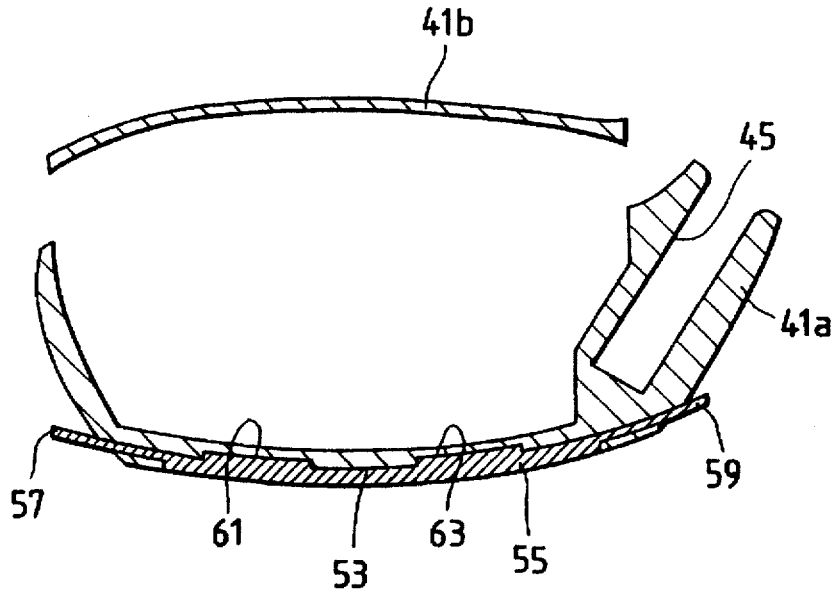
FIG. 3 is an exploded sectional view of the shell forming the head body shown in FIG. 1.
Figure 4:
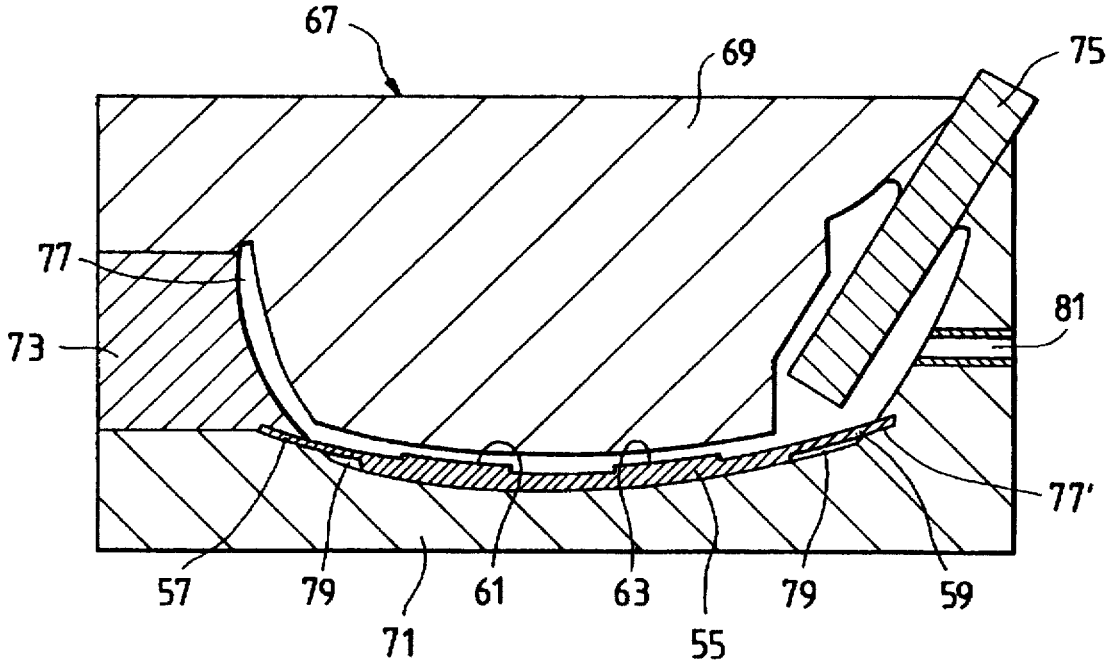
FIG. 4 is a sectional view of the mold used for manufacturing the head shown in FIG. 1.

The head body 41 in the form of a hollow shell is manufactured in such a manner that the shell body 41*a* and the top 41*b* are separately cast and then welded to each other as illustrated in FIG. 3. The shell body 41*a* is cast by the mold 67 as illustrated in FIG. 4. The protruding pieces 57, 59 are involved in the material during the process of casing of the shell body 41*a*, so that the sole plate 55 is attached onto the external surface of the shell body 41*a*.

The mold 67 includes 3 blocks, namely an upper mold 69, lower mold 71 and sliding mold 73, and a pin 75 which is inserted into the upper mold 69 to form the hosel attaching section 45. In the mold 67, a cavity 77 is formed, the dimensions of which are slightly larger than those of the objective shape of the shell body 41*a* in view of finish work for the shell body 41*a*.

The sole plate 55 made of the aforementioned metal such as stainless steel, copper alloy or nickel alloy is put on the lower mold 71. As described above, the sole plate 55 has a pair of protruding pieces 57, 59 protruding from the periphery of the sole plate 55 toward the toe and heel sides of the head body 41 in the opposite direction with respect to the center of the sole plate 55. An end of one of the protruding pieces 59 is inserted into a recess 77' provided in the lower mold 71, and then the sole plate 55 is put on the lower mold 71. The sliding mold 73 is then set from a diagonal upper position, so that an end of the other protruding piece 57 is interposed between the sliding mold 73 and the lower mold 71. Therefore, the sole plate 55 is positively held by the lower mold 71 and the sliding mold 73.

Between the lower mold and each of the protruding pieces 57, 59, there is provided a gap 79 into which the material forming the shell body 41*a* is supplied, so that the protruding pieces 57, 59 except for the end portions can be embedded in the material.

After the sliding mold 73 is set to retain the sole plate in place, the upper mold 69 is set on the lower mold 71 and the sliding mold 73 as illustrated in FIG. 4. Then, material for forming the head body such as magnesium alloy or aluminum alloy is poured into the cavity 75 through the pouring port 81, and the poured material is solidified.

After the material for forming the head body has been solidified, the upper mold 69, lower mold 71 and sliding mold 73 are removed and the pin 75 is pulled out. In this way, the shell body 41*a* illustrated in FIG. 3 is cast. Although not shown in the drawing, a top portion 41*b* is cast from the same metal as that of the shell body 41*a* using another mold different from the mold described above. Then as illustrated in FIG. 3, the cast shell body 41*a* and the top portion 41*b* are welded with each other. The filling member 43 is charged into the head body 41 from the filling member pouring port 83 provided in the sole portion 51 as illustrated in FIG. 2, and then a cover 85 is attached to the filling member pouring port 83. A shaft 49 is attached to the hosel attaching section 45 through the hosel 47.

In the finish machining process of the head body 41, end portions of the protruding pieces 57, 59 which outwardly protrude from the head body 41 are respectively cut along the configuration of the head body 41. Due to the foregoing, the head 65 is manufactured as illustrated in FIG. 1, in which the sole plate 55 is attached to the sole 41 through the protruding pieces 57, 59 which are embedded in the head body 41, and the respective ends 57*a*, 59*a* are exposed onto the external surface of the head body 41.

Since the metallic head 65 of this embodiment is constructed in the above manner, the center of gravity of the head 65 is lowered by the action of the sole plate 55 which functions as a weight adjusting member, to thereby make it easier for a golf player to swing a golf club to which the metallic head 65 of this embodiment is attached.

When a ball is hit by the head 65, the hosel 47 absorbs an impact given by the ball, so that the vibration transmitted from the head body 41 to the shaft 49 can be reduced.

For example, when a lower portion of the head 65 on the face side gets into the ground in the hitting process of a ball, since the sole plate 55 is attached in the recess 53 provided in the sole portion 51 in such a manner that the surface of the sole plate 55 is flush with the surface of the sole portion 51, the sole plate 55 is not given a force to disconnect the sole plate 55 from the head body 41. Further, the sole plate 55 is strongly held by the protruding pieces 57, 59 which are embedded in the head body 41 except the ends exposed onto the external surface of the head body 41. Accordingly, the sole plate 55 is positively held in the recess 53.

Consequently, according to the head 65 of this embodiment, even when an impact is given to the head body 41 in the hitting of a ball, the sole plate 55 is not disconnected from the head body 41, and when a sole plate 55 made of metal, the specific gravity of which is higher than that of the head body 41, is attached to the sole 51 of the head body 41, the sole plate 55 functions as a weight adjusting member to lower the center of gravity of the head 65.

According to the manufacturing method of the head 65 of this embodiment, in the casting process of the shell body 41*a*, the sole plate 55 can be positively held at a predetermined position through the protruding pieces 57, 59 which protrude approximately in the opposite direction with respect to the center of the plate. Accordingly, slippage of the sole plate 55 is not caused. It is possible to easily and positively manufacture the head 65 capable of providing the aforementioned effects.

Figure 5:
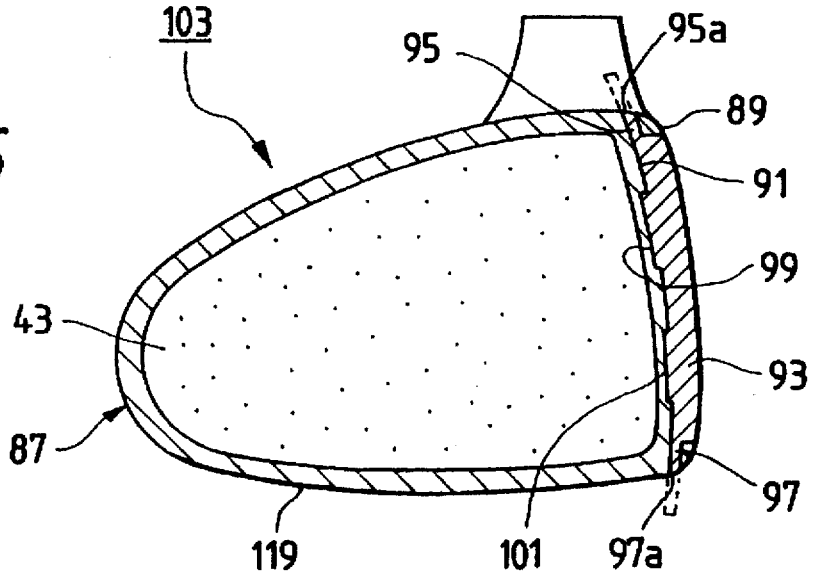
FIG. 5 is a sectional view of a golf club head according to another embodiment of the invention.

FIG. 5 is a view showing a golf club head according to another embodiment of the invention. Concerning the head of this example, a face plate is attached onto the face of the head body.

In FIG. 5, numeral 87 is a head body in the form of a hollow shell. The head body 87 is filled with the filling material 43 made of foaming synthetic resin.

A recess 91 having a bottom is provided on the face 89 of the head body 87. To the recess 91, a face plate 93 is attached in such a manner that the surface of the face plate 93 is flush with the surface of the face 89 around the recess. The face plate 93 is made of metal, the melting point of which is higher than that of the head body 87, and the specific gravity of which is lower than that of the head body 87. For example, when the head body 87 is made of stainless steel, the face plate 93 is made of titanium, and when head body 87 is made of nickel alloy or cobalt alloy, the face plate 93 is made of stainless steel, titanium or titanium alloy, and when the head body 87 is made of copper alloy, the face plate 93 is made of nickel alloy, beryllium, beryllium alloy, titanium alloy, cobalt alloy or stainless steel, and when the head body 87 is made of aluminum alloy, the face plate 93 is made of beryllium or beryllium alloy.

The material the specific gravity of which is higher than that of the head body 87 may be used for the face plate 93 as long as the material is high in elastic module. For example, in the case where the head body 87 is made of aluminum alloy, titanium or titanium alloy may be used for the face plate 93.

In the periphery of the face plate 93, there are provided a pair of protruding pieces 95, 97 which protrude onto the top and sole sides of the head body 87 in the opposite direction with respect to the center. The protruding pieces 95, 97 are embedded in the head body 87, and ends 95*a*, 97*a* are exposed onto the external surface of the head body 87. Protruding portions 99, 101 are provided on the back side of the face plate 93 and engaged with the bottom portion of the recess 91.

The head 103 of this embodiment is manufactured as follows.

Figure 6:
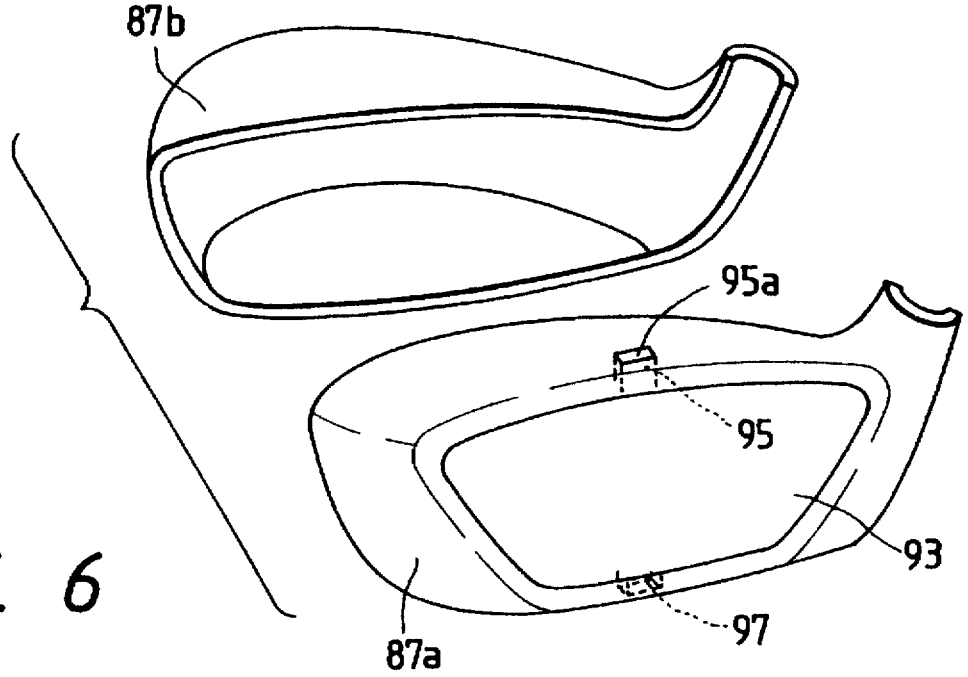
FIG. 6 is an exploded perspective view of the shell forming the head body shown in FIG. 5.

As illustrated in FIG. 6, the head body 87 in the form of a hollow shell is manufactured in such a manner that a front shell 87*a* forming the face side of the head body 87 and a rear shell 87*b* forming the back side of the head body 87 are separately cast and then welded to each other. The protruding pieces 95, 97 are involved in the molten metal in the front shell body 87*a* in the process of casting of the front shell body 87*a*, so that the face plate 93 is attached onto the external surface of the front shell body 87*a*.

Figure 7:
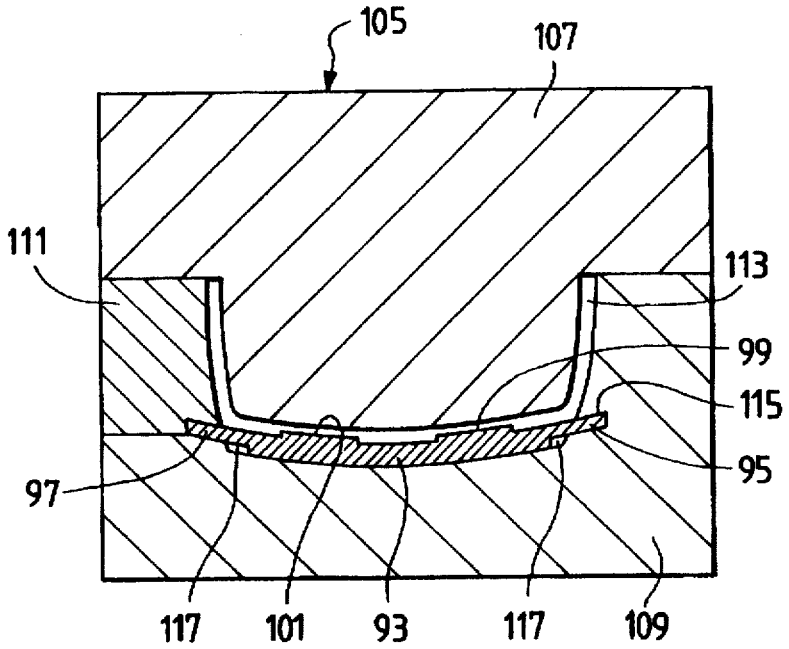
FIG. 7 is a sectional view used for manufacturing the head shown in FIG. 5.
Figure 8:
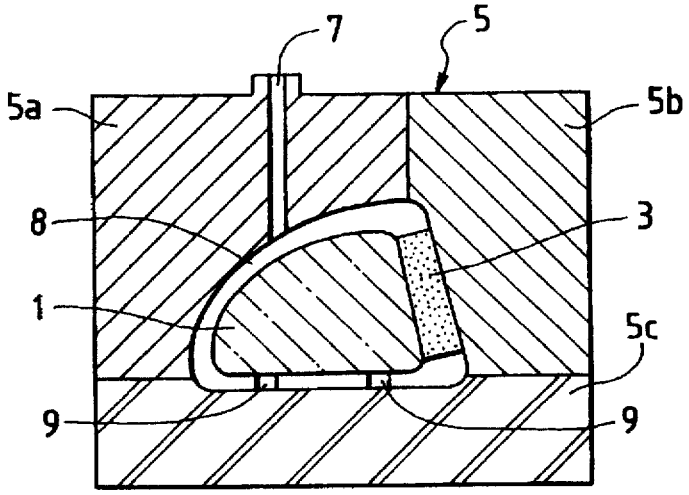
FIG. 8 is a sectional view of a mold used for manufacturing a conventional head.
Figure 9:
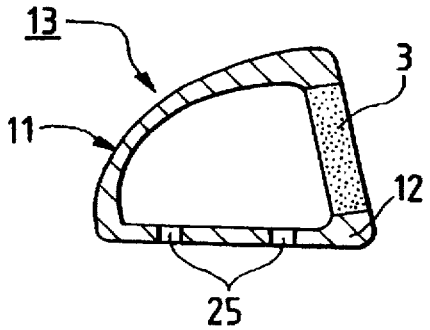
FIG. 9 is a sectional view of the conventional head manufactured by the mold shown in FIG. 8.
Figure 10:
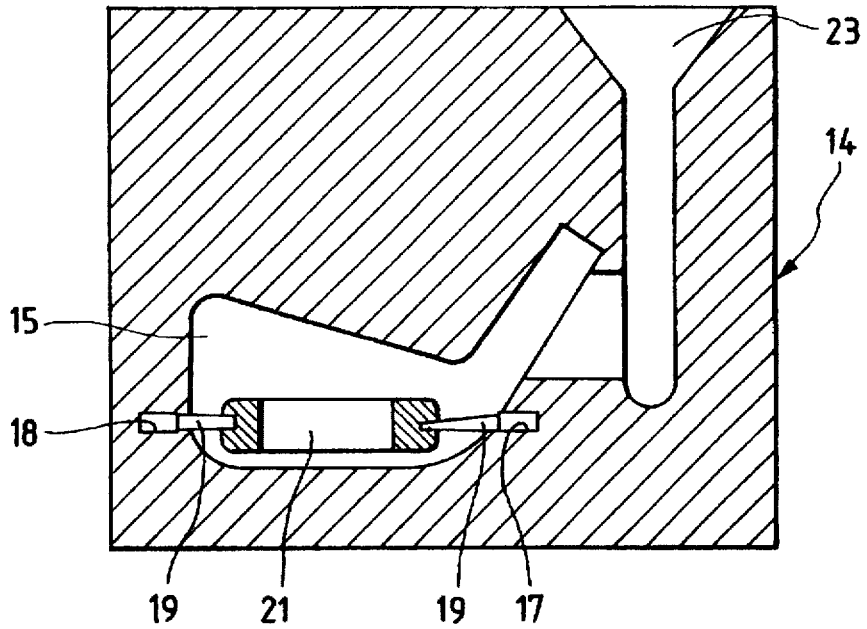
FIG. 10 is a sectional view of a mold used for manufacturing another conventional head.
Figure 11:
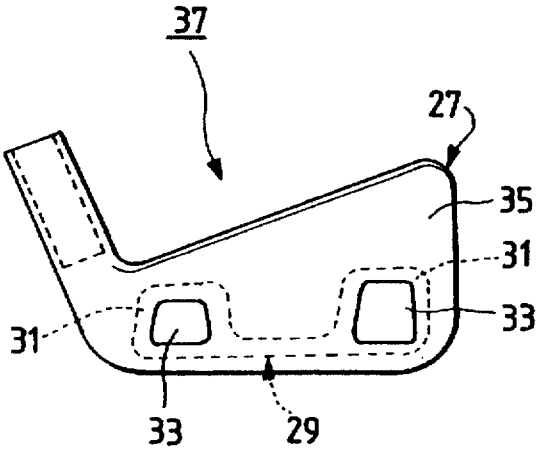
FIG. 11 is a front view of yet another conventional head.
Figure 12:
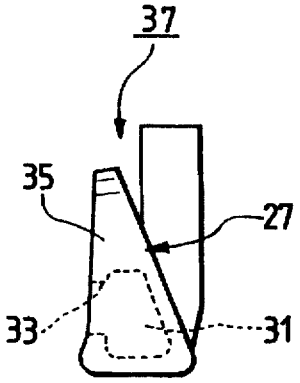
FIG. 12 is a side view of the conventional head shown in FIG. 11.

The front shell 87*a* is cast by the mold 105 shown in FIG. 7. The mold 105 includes 3 blocks, namely an upper mold 107, lower mold 109 and sliding mold 111. In the mold 105, a cavity 113 is formed, the dimensions of which are slightly larger than those of the objective shape of the front shell body 87*a* in view of the finish machining of the front shell body 87*a*.

First, the face plate 93 made of the above metal is arranged on the lower mold 109. The face plate 93 has a pair of protruding pieces 95, 97 which are integrally formed in the periphery of the face plate 93 in such a manner that the protruding pieces 95, 97 are protruded in the opposite direction onto the top and sole sides of the head body 87 that has been molded. First, with an end of one of the protruding pieces 95 be inserted into a recess 115 provided in the lower mold 109, the face plate 93 is arranged on the lower mold 109, and then the sliding mold 111 is set from an upper diagonal position so that an end of the other protruding pieces 97 is interposed between the sliding mold 111 and the lower mold 109. Due to the foregoing, the face plate 93 is positively held by the lower mold 109 and the sliding mold 111.

When the face plate 93 is positioned on the lower mold 109 in place in the above-noted manner, a gap 117 is formed between the lower mold 109 and each of the protruding pieces 95, 97 so that the protruding pieces 95, 97 except for the end portions can be embedded in the material for forming the head body.

Then, as illustrated in FIG. 7, the upper mold 107 is set on the lower mold 109 and the sliding mold 111, and the material for forming the head body such as magnesium alloy or aluminum alloy is charged into the cavity 113 and solidified.

After the material for forming the head body has been solidified, the upper mold 107, lower mold 109 and sliding mold 111 are removed. In this way, the front shell 87*a* illustrated in FIG. 6 is cast. Although not illustrated in the drawing, the rear shell 87*b* is cast from the same metal as that of the front shell 87*a* using another mold. As illustrated in FIG. 6, the front shell 87*a* and rear front shell 87*b*, which have been cast, are welded with each other, and the filling member 43 is charged into the head body 87 from a filling member pouring port not shown, and then a cover is attached.

In the finish machining process of the head body 87, end portions of the protruding pieces 95, 97 which outwardly protrude from the head body 87 are respectively cut along the configuration of the head body 87. Due to the foregoing, the head 103 is manufactured as illustrated in FIG. 5, in which the face plate 93 is attached to the face portion 89 through the protruding pieces 95, 97 which are embedded in the head body 87 and are provided with the ends 95*a*, 97*a* exposed onto the external surface of the head body 87.

Since the head 103 of this embodiment is constructed in the above manner, when a golf player swings a golf club to which the head 103 is attached, the face plate 93 gives a repulsive force to a ball effectively, so that the flying distance of the ball can be extended.

Since the face plate 93 is strongly supported by the protruding members 95, 97 embedded in the head body 87, the face plate 93 is positively held in the recess 91. Therefore, even if the golf club is given a shock when it hits a ball, the face plate 93 does not come off from the face 89.

As described above, according to the head 103 of this embodiment, the face plate 93 does not come off from the head body 87 even if an impact is given to the head 103 by a ball. According to the method of manufacturing the head 103 of the present invention, in the process of casting the front shell 87*a*, the face plate 93 is positively held at predetermined positions through the protruding pieces 95, 97 which protrude in the opposite direction with respect to the center of the plate. Therefore, slippage of the face plate 93 can be avoided, and further the head 65 capable of providing the above effects can be very easily and positively manufactured.

The head bodies 41, 87 in the form of hollow shells in the above-noted embodiments are filled with the filling member 43. Of course, the head bodies 41, 87 may not be filled with the filling member 43, and the hollow condition may be maintained in the head bodies 41, 87.

It should be noted that the present invention is not limited to the aforementioned metallic head and manufacturing method thereof. It is possible to apply the present invention to a head and manufacturing method thereof, in which the head body is made in such a manner that a fiber reinforced resin layer such as a carbon fiber reinforced resin layer or a glass fiber reinforced resin layer is provided on the surface of the core (filling member).

That is, although not shown in the drawing, even in the case of a head made up of a core and a fiber reinforced resin layer provided on the surface of the core, in which a metallic or resin face plate and/or sole plate are attached to the face and sole, the similar advantage can be obtained by arranging such that a pair of protruding pieces which protrude in the opposite direction with respect to the center of the head are respectively embedded in portions of the head body which are located around the peripheries of the face and/or sole plates with the ends of the protruding pieces be exposed onto the external surface of the head body.

The head having the advantages described above can be easily manufactured by the method described as follows: At least a pair of protruding pieces which protrude in the opposite direction with respect to the center of the head body are integrally formed in the peripheries of the face and sole plates attached onto the external surface of the head body, and a core supporting protruding pieces are provided, and the core made of foaming synthetic resin is supported through the core supporting protruding pieces. These are arranged in the mold composed of a plurality of blocks, and the material for forming the head boy is charged into the mold and solidified. While each protruding piece except for the end portion is embedded in the material forming the head body, the plate is attached onto the external surface of the head body, and the end of the protruding piece which protrudes from the head body is removed along the configuration of the head body.

As described above, according to the head of the invention, a plate such as a face plate or a sole plate is strongly supported by the protruding pieces embedded in the head body extended in such a manner that the ends are exposed onto the external surface of the head body. Accordingly, the plate is positively held by the head body, and even if vibration is given to the head when the golf club is used, the plate does not come off from the head body.

According to the methods of manufacturing a head of the invention, it is possible to easily manufacture the head capable of providing the above effects. In case that the protruding pieces are interposed between the blocks of the mold in the process of manufacturing the head body and positively held at predetermined positions, the displacement of the protruding pieces can be positively avoided in a simple manner.

What is claimed is:

1. A golf club head comprising:

a head body; and a plate attached onto said head body, said plate having at least a pair of protruding pieces protruding from a periphery of said plate in a direction substantially parallel to said plate and approximately in opposite directions to each other, wherein said protruding pieces are embedded in and elongated through said body thereby positively securing said plate to said head body and preventing detachment therefrom, said protruding pieces including end faces exposed from said head body.

2. A golf club head according to claim 1, wherein said plate is attached to and fitted in a recess so that said plate is flush with an external surface of said head body.

3. A golf club head according to claim 2, wherein said protruding pieces are exposed from surfaces of said head body located adjacent said external surface.

4. A golf club head according to claim 1, wherein a recess and a projection are respectively formed on mutually facing surfaces of said head body and said plate, said recess and said projection are fitted to each other when said plate is attached to said head body.

5. A golf club head according to claim 1, wherein said plate is made of metal, and said head body is made of one of fiber-reinforced resin and metal.

6. A golf club head according to claim 1, wherein said plate is attached to a sole of said head body, the specific gravity of said plate being higher than said head body.

7. A golf club head according to claim 1, wherein said plate is attached to a face of said head body.

8. A golf club head according to claim 6, wherein said plate is higher in elastic module than said head body.

9. A golf club head according to claim 1, wherein said head body includes a hollow member, and said protruding pieces are embedded in said hollow member.

10. A golf club head comprising:

a head body; and a plate attached to said head body, said plate having at least a pair of protruding pieces protruding from a periphery of said plate and extending substantially parallel to said plate, wherein said protruding pieces are each embedded in one of a plurality of recesses formed in said head body thereby positively securing said plate to said head body and preventing detachment therefrom, said plate and said protruding pieces are integrally formed as a unitary body.

11. A golf club head according to claim 10, wherein said protruding pieces extend into said recess formed in said head body so as to be exposed from said head body.

12. A golf club head according to claim 10, wherein a plurality or recesses and projections are respectively formed on mutually facing surfaces of said head body and said plate, said recesses and said projections engage each other when said plate is attached to said head body, said plate said protruding pieces and said projections are all integrally formed as a unitary body.

13. A golf club head according to claim 12, wherein said plate forms a face plate.

14. A golf club head according to claim 12, wherein said plate forms a sole plate.

15. A golf club head according to claim 10, wherein said protruding pieces have a peripheral surface and an end face, each of said peripheral surfaces of said protruding pieces having a portion encircled by one of said recesses to thereby positively secure said plate to said head body.

* * * * *